United States Patent [19]

Clements

[11] Patent Number: 4,615,459

[45] Date of Patent: Oct. 7, 1986

[54] LID WITH DRINKING OPENING

[75] Inventor: Jack D. Clements, Ada, Okla.

[73] Assignee: Solo Cup Company, Highland Park, Ill.

[21] Appl. No.: 690,669

[22] Filed: Jan. 11, 1985

[51] Int. Cl.[4] ..... B65D 41/26

[52] U.S. Cl. ..... 220/254; 220/90.4; 229/7 R; 229/43

[58] Field of Search ..... 220/90.2, 90.4, 268, 220/254; 229/43, 7 R

[56] References Cited

U.S. PATENT DOCUMENTS

| | | | |
|---|---|---|---|
| 2,176,898 | 10/1939 | Fried | 220/268 |
| 2,922,563 | 1/1960 | Aldington | 229/43 |
| 3,362,569 | 1/1968 | Geiger | 220/268 |
| 3,583,596 | 6/1971 | Brewer | 229/43 X |
| 3,797,696 | 3/1974 | Dibrell | 220/90.4 |
| 3,927,794 | 12/1975 | Erdman | 220/90.4 X |
| 4,056,210 | 11/1977 | Boyle | 220/268 X |
| 4,078,693 | 3/1978 | Asbury | 220/268 |
| 4,081,103 | 3/1978 | Zoellick | 220/90.4 X |
| 4,106,660 | 8/1978 | Boyle | 220/90.4 |
| 4,350,260 | 9/1982 | Prueher | 220/90.4 X |
| 4,359,170 | 11/1982 | Edlund | 220/268 |

*Primary Examiner*—Allan N. Shoap

*Attorney, Agent, or Firm*—Fitch, Even, Tabin & Flannery

[57] ABSTRACT

A drinking cup lid includes a top wall having a surface projecting downwardly therefrom for engagement by a finger in an automatic vending machine, and includes a folding tab for providing a drinking opening in the lid.

1 Claim, 2 Drawing Figures

LID WITH DRINKING OPENING

BACKGROUND OF THE INVENTION

The invention relates to a lid for a drinking cup, and more particularly to a lid suitable for dispensing from a vending machine.

It is well known for vending machines to dispense drinks in cups. The lid of the present invention is intended for use in a vending machine of this type which automatically places a lid on each cup after filling it.

To be suitable for such use, a lid should include means to enable the lid to be placed on a cup by automated equipment and means to retain the lid in position on the cup. The lid should also be capable of economical manufacture, for example by vacuum forming, as such lids will typically be used only once, and should not contribute greatly to the cost of the drink purchased.

Lids of this type should be capable of stacking compactly so that a plurality of the lids may be stored conveniently in a vending machine. Preferably, the lid should resist lateral movement relative to other lids in a stack so as to contribute stability to the stack. Also, it is desirable that the lids not be subject to binding together due to longitudinal compression of the stack, as such binding would make it difficult to separate a lid from the stack.

Another desirable feature is the provision of means to enable drinking from the cup without removal of the lid. This enables one to drink while walking or driving, while minimizing the risk of spills.

One lid which addresses some of the above considerations, but which is not suitable for the vending machine usage of the lid of the present application, is disclosed in U.S. Pat. No. 3,583,596, which is commonly assigned with the present application.

Another prior art lid which has been manufactured by the assignee of the present invention is similar to the lid of U.S. Pat. No. 3,583,596 and includes an X-shaped straw slot and a circular channel in its top wall, but does not have means to enable one to drink directly from the associated cup without either removing the lid or using a straw. In that lid, the purpose of the channel is to receive a downwardly extending rim on the bottom of a cup. This provides stability when a cup is stacked upon another cup having a lid thereon.

The lid of the present invention is intended for use in a vending machine wherein a finger engages the underside of the lid to displace it laterally from a stack into a position where it may be snapped onto an associated cup after a beverage has been dispensed into the cup. The lid might alternatively be used by fast food outlets and snapped on by hand.

SUMMARY OF THE INVENTION

In accordance with the present invention, there is provided a drinking cup lid which includes a downwardly projecting surface on its underside for engagement by a finger in a vending machine, and which has a movable tab formed therein to define a drinking opening. The tab is defined by a generally U-shaped slit formed at substantially planar portions of the lid.

Accordingly, it is a general object of the invention to provide a novel drinking cup lid for use in a vending machine.

Further objects and features of the invention will become apparent in the following description and the accompanying drawings.

DETAILED DESCRIPTION OF PREFERRED EMBODIMENT

Figure 2:
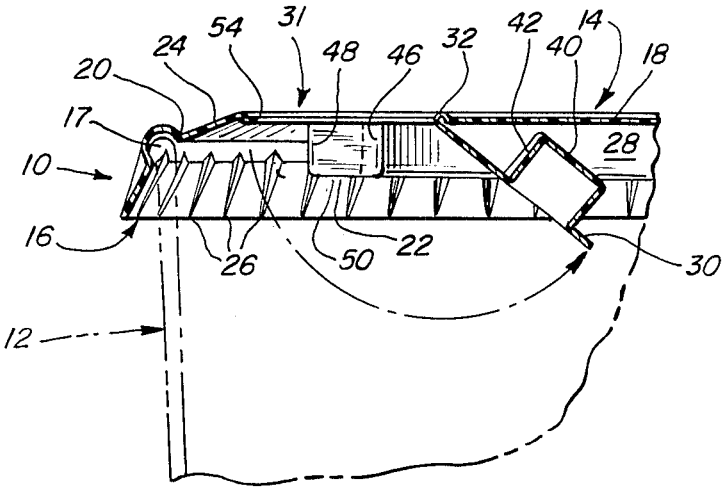
FIG. 2 is a fragmentary sectional view of the lid of the present invention shown on an enlarged scale taken substantially along line 2—2.

The invention is preferably embodied in a lid 10 for mounting on a drinking cup 12 (shown fragmentarily in phantom in FIG. 2). Herein the lid will be described in an orientation corresponding to the drawings, with terms such as "top" and "vertical" used for reference purposes. It will be appreciated that during use, the lid will typically assume various orientations.

The lid includes a top wall 14 and a generally frustoconical skirt portion 16. The skirt portion 16 extends radially outwardly and downwardly from the top wall 14 and includes means for gripping the lip 17 of the cup 12. The top wall 14 has a generally planar central portion 18 and a generally circular periphery 20. A generally C-shaped downwardly projecting portion or channel 22 is located between the central portion 18 and the periphery 20.

To aid in gripping of the lip of the cup, a generally circular, generally frustoconical corrugated strip 24 extends about the circumference of the top wall 14, and the skirt portion includes a plurality of flutes 26. As shown in FIG. 2, the corrugated strip 24 slopes upwardly and inwardly from the periphery 20 of the top wall 14. The functions of the corrugated strip 24 and flutes 26 are described in detail in above-referenced U.S. Pat. No. 3,583,596.

The lid 10 defines an axis—i.e., a line through the center of the top wall 14 and perpendicular thereto—which will be used herein for reference purposes. The downwardly projecting portion or channel 22 provides a surface 28 facing radially inward for engagement by a laterally moving finger (not shown) in a vending machine so that a lid on the bottom of a vertical stack may be displaced laterally from the stack by the finger so as to be positioned for placement on a cup to be dispensed. The surface 28 is disposed at a predetermined radius from the axis of the lid 10. In the illustrated embodiment, this surface 28 is perpendicular to the top wall 14.

Figure 1:
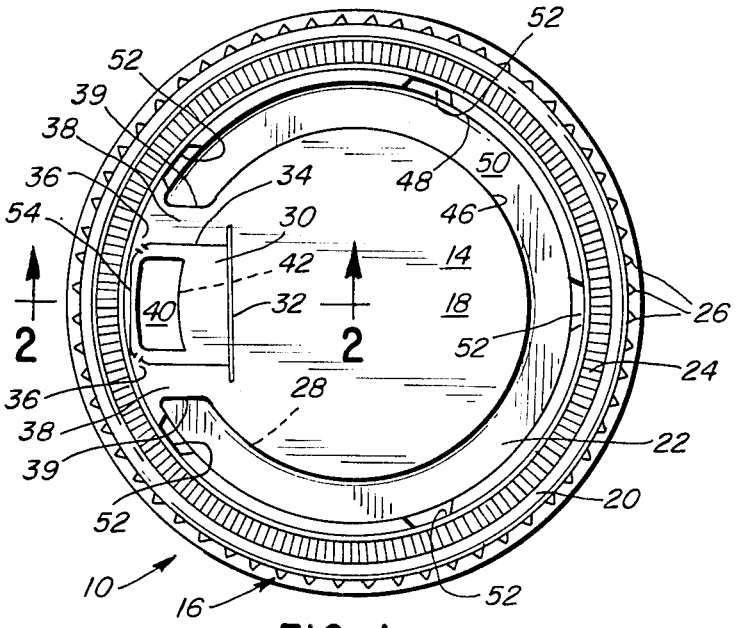
FIG. 1 is a plan view of a lid in accordance with the present invention.

The lid 10 herein includes a tab 30 which may be folded downwardly to provide an opening 31 (FIG. 2) for drinking from the cup 12 or for insertion of a straw. In FIG. 2, the tab 30 is shown in a downwardly folded configuration of FIG. 1 in solid lines, and shown in the configuration in broken lines. The tab 30 folds downwardly along a preformed fold line 32. The tab 30 is defined by a generally U-shaped slit 34 which is interrupted at two points by bridges 36 (FIG. 1) between the tab 30 and the adjacent portions of the top wall 14 so as to prevent accidental displacement of the tab 30.

In accordance with the invention, the slit 34 is formed through generally planar portions 38 of the top wall 14 which are coplanar with the generally planar central portion 18 thereof, and which extend radially outward from the central portion 18 between the ends 39 of the C-shaped channel 22; and the tab 30 has a downwardly projecting boss 40 thereon having an inwardly facing surface 42 disposed at the same radius from the axis of the lid as the inwardly facing surface 28, so that the two surfaces 28 and 42 together define a noncontinuous surface of revolution about the axis of the lid. More particularly, the surfaces 28 and 42 provide a substantially cylindrical surface interrupted only adjacent the generally planar extensions 38 from the top wall 14 which define gaps between the two surfaces 28 and 42. When this substantially cylindrical surface is engaged by a finger having a width greater than that of these gaps, action of the finger on the lid 10 is independent of the angular orientation of the lid. This enables the lids 10 to be handled automatically within the vending machine without having to be oriented in any particular direction.

The channel 22 herein is defined by a substantially vertical inner wall 46, a concentric substantially vertical outer wall 48 and a substantially horizontal bottom wall 50 extending therebetween. In addition to providing the radially inwardly facing surface 28 on its inner wall 46, the channel 22 also provides a receptacle for small amounts of liquid which may slop onto the top of the lid 10.

One problem which may arise in the stacking of lids 10 is that the lids may telescope and bind to one another when the stack is compressed longitudinally. To prevent such binding, minor variations are preferably introduced into the configurations of different lids 10 so that adjacent lids are unlikely to be identical, and interference will prevent a particular lid from telescoping with an adjacent lid. Herein, the variations take the form of indentations 52 in the outer surface of the C-shaped channel 22.

The inner wall 46 is relatively stiff so as to prevent excessive deformation of the inner wall 46 by the finger, and is oriented vertically so that horizontal force on the inner surface 28 does not tend to cam the lid upward, as would horizontal force on the inner surface of the frustoconical skirt portion 16.

The lid 10 is manufactured in a two-step process, the first being a vacuum-thermoforming operation and the second being a slitting operation to define the tab 30. Provision of the planar extensions 38 greatly facilitates the slitting operation as compared with forming a slit on a nonplanar surface.

The slit 34 does not extend into the corrugated strip 24, but is disposed entirely radially inward thereof so as not to interfere with its gripping function. When the lid 10 is placed on the cup 12, the tab 30 is maintained in its closed position by the bridges 36 and the lid is held tightly on the cup 12, so that the possibility of accidental spillage is almost entirely precluded.

The radially outermost portion 54 of the slit 34 is directly adjacent the inner diameter of the corrugated strip 24. The proximity of this portion 54 of the slit 34 to the inner diameter of the corrugated strip 24, in conjunction with the slope of the corrugated strip 24, facilitates emptying of the cup 12. If the cup is tilted so that the portion 54 of the slit is at the lowermost part of the lid 10, almost all of the liquid in the cup 12 will flow out through the opening 31.

Frequently, a purchaser of a drink in a cup as described above may abandon the cup or place it on the floor of a vehicle therein. Should the cup become positioned on its side, it is desirable that the remaining liquid not spill through the drinking opening 31. Positioning of the radially outermost portion 54 of the slit 34 radially inwardly of the corrugated strip 24 helps to prevent such spillage, as the corrugated strip 24 acts to retain such residual liquid within the cup.

Another feature of the lid 10 is that the tab 30 remains attached to the lid. In the past, openings in some lids have been formed by completely removing a portion of the lid. Similarly, bottles have removable caps and many cans have removable tabs. Removable caps, tabs, etc. contribute to unwanted litter, and some states have laws prohibiting cans, etc., with throw-away tabs. Thus, there is a need for lids of the type described above wherein the tab remains connected to the lid.

From the foregoing it will be appreciated that the invention provides a new and improved lid for a drinking cup. While a preferred embodiment has been described and illustrated, the invention is not intended to be restricted to this or any particular embodiment.

What is claimed is:

1. A drinking cup lid comprising:

a top wall having a generally circular periphery, said top wall including a substantially horizontal, substantially planar central portion, a C-shaped downwardly-projecting channel partially surrounding said central portion, a downwardly projecting boss disposed between the ends of the generally C-shaped channel, and a pair of generally planar extensions extending outward from said central portion, each of said extensions being between the boss and a respective one of the ends of said C-shaped channel; and a skirt portion extending radially outwardly and downwardly from said top wall about its periphery for gripping a drinking cup lid;

said C-shaped channel being defined by a substantially vertical, C-shaped inner wall, a substantially vertical C-shaped outer wall, a substantially horizontal, C-shaped bottom wall extending between said inner wall and said outer wall, and a pair of substantially vertical end walls defining the ends of the channel;

said inner wall having a substantially vertical inner surface disposed at a predetermined radius from the central vertical axis of the lid;

said downwardly-projecting boss having a substantially vertical inner surface disposed at said predetermined radius from said vertical axis;

said top wall having a movable tab defined therein by a generally U-shaped slit and a transverse fold line, the slit including first and second substantially parallel portions extending from the central portion of the top wall through the generally planar extensions, and a transverse portion connecting the outer ends of said substantially parallel portions, said fold line connecting the inner ends of said substantially parallel portions so that said tab can be folded downward to provide an opening in said lid while remaining attached thereto along said fold line, said tab including said downwardly projecting boss, said top wall further including an annular, substantially frustoconical corrugated strip extending radially inward and upward from the outer periphery of the top wall, said transverse portion of said generally U-shaped slit being directly adjacent said corrugated strip between said corrugated strip and said boss.

* * * * *